US012780395B2

(12) United States Patent
Phillips et al.

(10) Patent No.: US 12,780,395 B2
(45) Date of Patent: Nov. 3, 2026

(54) SYSTEMS AND METHODS FOR STATION KEEPING WITH WATERCRAFT

(71) Applicant: ARC BOAT COMPANY, San Francisco, CA (US)

(72) Inventors: Andrew Phillips, San Francisco, CA (US); Amogh Dixit, San Francisco, CA (US)

(73) Assignee: ARC BOAT COMPANY, San Francisco, CA (US)

( * ) Notice: Subject to any disclaimer, the term of this patent is extended or adjusted under 35 U.S.C. 154(b) by 6 days.

(21) Appl. No.: 18/910,215

(22) Filed: Oct. 9, 2024

(65) Prior Publication Data

US 2025/0121925 A1 Apr. 17, 2025

Related U.S. Application Data

(60) Provisional application No. 63/543,754, filed on Oct. 12, 2023.

(51) Int. Cl.
*B63H 25/42* (2006.01)
*B63H 25/04* (2006.01)

(52) U.S. Cl.
CPC ..... *B63H 25/42* (2013.01); *B63H 25/04* (2013.01)

(58) Field of Classification Search
CPC ... B63H 25/04; B63H 2025/045; B63H 25/42
See application file for complete search history.

(56) References Cited

U.S. PATENT DOCUMENTS 6,357,375 B1 3/2002 Ellis
6,678,589 B2 * 1/2004 Robertson ..... B63H 25/42 701/530

(Continued)

FOREIGN PATENT DOCUMENTS

DE 102022130396 A1 * 5/2023 ..... B63H 25/04
WO WO-2005054050 A2 * 6/2005 ..... B63H 25/04

OTHER PUBLICATIONS

Walker, Kyle L et al. "Impact of Thruster Dynamics on the Feasibility of ROV Station Keeping in Waves." Global Oceans 2020: Singapore—U.S. Gulf Coast. IEEE, 2020. 1-7. Web. (Year: 2020).*

(Continued)

*Primary Examiner* — Erin D Bishop
*Assistant Examiner* — Keith A von Volkenburg
(74) *Attorney, Agent, or Firm* — Casimir Jones, S.C.; Brian F. Bradley

(57) ABSTRACT

A method includes receiving a target position for a watercraft; determining a current position and a current heading axis of the watercraft; and determining a position error based on the difference between the target position and the current position. A position error axis is defined between the target position and the current position. The method further includes determining a heading error based on the current heading axis and a desired heading axis. The desired heading axis is orthogonal to the position error axis. The method further includes activating a plurality of thrusters to minimize the heading error; determining when the heading error is less than a threshold; and activating the plurality of thrusters to minimize the position error and the heading error in response to determining the heading error is less than the threshold.

19 Claims, 6 Drawing Sheets

(56) References Cited

U.S. PATENT DOCUMENTS

| | | | | |
|---|---|---|---|---|
| 7,305,928 | B2 | 12/2007 | Bradley et al. | |
| 7,727,036 | B1 | 6/2010 | Poorman et al. | |
| 8,417,399 | B2 | 4/2013 | Arbuckle et al. | |
| 8,478,464 | B2 | 7/2013 | Arbuckle et al. | |
| 8,924,054 | B1 | 12/2014 | Arbuckle et al. | |
| 9,828,075 | B1 | 11/2017 | Hartman | |
| 10,095,232 | B1 | 10/2018 | Arbuckle et al. | |
| 10,322,787 | B2 | 6/2019 | Ward | |
| 10,324,468 | B2 | 6/2019 | Arbuckle et al. | |
| 10,331,137 | B2 | 6/2019 | Miller et al. | |
| 10,437,248 | B1 | 10/2019 | Ross et al. | |
| 10,633,072 | B1 | 4/2020 | Arbuckle et al. | |
| 10,640,190 | B1 | 5/2020 | Gonring | |
| 10,671,073 | B2 | 6/2020 | Arbuckle et al. | |
| 10,717,502 | B1 | 7/2020 | Hartman | |
| 10,782,690 | B1 | 9/2020 | Miller et al. | |
| 10,795,366 | B1 | 10/2020 | Arbuckle et al. | |
| 10,829,191 | B2 | 11/2020 | Wong et al. | |
| 10,845,811 | B1 | 11/2020 | Arbuckle et al. | |
| 11,059,558 | B2 | 7/2021 | Wong et al. | |
| 11,247,753 | B2 | 2/2022 | Arbuckle et al. | |
| 11,260,949 | B2 | 3/2022 | Ward | |
| 11,327,494 | B1 | 5/2022 | Arbuckle et al. | |
| 11,383,815 | B1 | 7/2022 | Miller et al. | |
| 11,827,329 | B1 | 11/2023 | Miller et al. | |
| 12,017,746 | B2 | 6/2024 | Wong et al. | |
| 12,065,230 | B1 | 8/2024 | Derginer et al. | |
| 12,110,088 | B1 | 10/2024 | Derginer et al. | |
| 12,134,454 | B1 | 11/2024 | Derginer et al. | |
| 12,252,224 | B2 | 3/2025 | Arbuckle et al. | |
| 12,258,115 | B2 | 3/2025 | Derginer et al. | |
| 12,263,915 | B1 | 4/2025 | Koetsier et al. | |
| 12,272,249 | B1 * | 4/2025 | Derginer | G01S 13/867 |
| 12,298,769 | B1 | 5/2025 | Arbuckle et al. | |
| 12,454,341 | B1 | 10/2025 | Arbuckle et al. | |
| 2007/0089660 | A1 * | 4/2007 | Bradley | B63H 21/22 114/144 A |
| 2008/0027597 | A1 * | 1/2008 | Barrett | B63H 25/46 701/21 |
| 2018/0231980 | A1 | 8/2018 | Arbuckle et al. | |
| 2021/0300517 | A1 | 9/2021 | Wong et al. | |
| 2022/0161908 | A1 | 5/2022 | Arbuckle et al. | |
| 2022/0348300 | A1 * | 11/2022 | Weber | B63H 25/46 |
| 2023/0049367 | A1 * | 2/2023 | Endrizzi | B63B 49/00 |
| 2023/0150643 | A1 * | 5/2023 | Weber | B63H 25/04 701/21 |
| 2023/0297110 | A1 * | 9/2023 | Afman | G05D 1/0206 701/21 |
| 2025/0382040 | A1 | 12/2025 | Arbuckle et al. | |

OTHER PUBLICATIONS

International Search Report and Written Opinion for International Application No. PCT/US2024/050421, mailed Feb. 21, 2025, 14 Pages.

https://yamahaoutboards.com/rigging/helm-master-ex; date accessed Feb. 26, 2025.

https://www.zmm.ca/en/us/gauges-and-controls/steering/skyhook-digital-anchor/; date accessed Feb. 26, 2025.

* cited by examiner

SYSTEMS AND METHODS FOR STATION KEEPING WITH WATERCRAFT

CROSS-REFERENCE TO RELATED APPLICATION

The present application claims priority to U.S. Provisional Application No. 63/543,754, filed Oct. 12, 2023, which is incorporated herein by reference in its entirety.

TECHNICAL FIELD

This disclosure relates to automatic positioning systems and methods for watercrafts (e.g., boats).

BACKGROUND

Conventional watercrafts include propulsion systems that are controlled to maintain the position of the watercraft in the water (e.g., "station keeping"). However, conventional station keeping methods require the activation of the main propeller or propellers to maintain the desired position of the watercraft in the water. Activation of the main propeller or propellers creates a swimming hazard. As such, conventional station keeping methods are not safe for swimmers to swim around the watercraft.

SUMMARY

The disclosure provides, in one aspect, A method comprising: receiving a target position for a watercraft; determining a current position and a current heading axis of the watercraft; and determining a position error based on the difference between the target position and the current position. A position error axis is defined between the target position and the current position. The method further comprises determining a heading error based on the current heading axis and a desired heading axis. The desired heading axis is orthogonal to the position error axis. The method further comprises activating a plurality of thrusters to minimize the heading error; determining when the heading error is less than a threshold; and activating the plurality of thrusters to minimize the position error and the heading error in response to determining the heading error is less than the threshold.

In some embodiments, the target position is received as an operator input on an input device.

In some embodiments, determining the current position is based on a measurement from a GPS, a measurement from an inertial measurement unit, or a combination thereof.

In some embodiments, determining the current heading axis is based on a measurement from an inertial measurement unit, a measurement from a compass, a measurement from a GPS, or a combination thereof.

In some embodiments, activating the plurality of thrusters to minimize the heading error causes the watercraft to rotate about a yaw axis.

In some embodiments, the threshold within a range of 5 degrees to 15 degrees.

In some embodiments, the watercraft includes a propeller configured to propel the watercraft when the propeller is energized, and wherein the propeller is deenergized during the method.

In some embodiments, the propeller is positioned along the current heading axis.

In some embodiments, the propeller is a first propeller, and wherein the watercraft includes a second propeller configured to propel the watercraft when the second propeller is energized, and wherein the second propeller is deenergized during the method, and wherein the first propeller and the second propeller are positioned spaced from the current heading axis.

In some embodiments, a propeller on the watercraft is deenergized in response to receiving the target position.

In some embodiments, the method further comprises activating the plurality of thrusters to minimize the heading error in response to determining the heading error is less than the threshold.

The disclosure provides, in one aspect, a watercraft including a hull defining a center bow-stern axis; a user input device; a propeller positioned along the center bow-stern axis; a first thruster coupled to the hull; and a second thruster coupled to the hull. The propeller is positioned between the first thruster and the second thruster along the bow-stern axis. The watercraft enters a station keeping mode in response to receiving an input on the user input device; wherein the propeller is de-energized in the station keeping mode; and wherein the first thruster and the second thruster are energized in the station keeping mode.

In some embodiments, the watercraft further includes a GPS antenna configured to measure a position of the watercraft.

In some embodiments, the watercraft further includes an inertial measurement unit configured to measure a heading of the watercraft.

In some embodiments, the watercraft further includes a compass configured to measure a heading of the watercraft.

In some embodiments, the first thruster and the second thruster have an adjustable output power.

In some embodiments, the orientation of the first thruster and the orientation of the second thruster are fixed relative to the hull.

In some embodiments, the user input device is a control knob, a touch screen, or a combination thereof.

In some embodiments, the propeller is coupled to an inboard motor.

In some embodiments, the first thruster is embedded in the hull and has an unexposed thruster propeller; and wherein the second thruster is embedded in the hull and has an unexposed thruster propeller.

Other aspects of the disclosure will become apparent by consideration of the detailed description and accompanying drawings.

BRIEF DESCRIPTION OF THE DRAWINGS

These and other features, aspects, and advantages of the present technology will become better understood with regards to the following drawings. The accompanying figures and examples are provided by way of illustration and not by way of limitation.

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present disclosure. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "an" and "the" include plural references unless the context clearly dictates otherwise. The present disclosure also contemplates other embodiments "comprising," "consisting of" and "consisting essentially of," the embodiments or elements presented herein, whether explicitly set forth or not.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

The term "coupled," as used herein, is defined as "connected," although not necessarily directly, and not necessarily mechanically. The term coupled is to be understood to mean physically, magnetically, chemically, fluidly, electrically, or otherwise coupled, connected or linked and does not exclude the presence of intermediate elements between the coupled elements absent specific contrary language.

Figure 6:
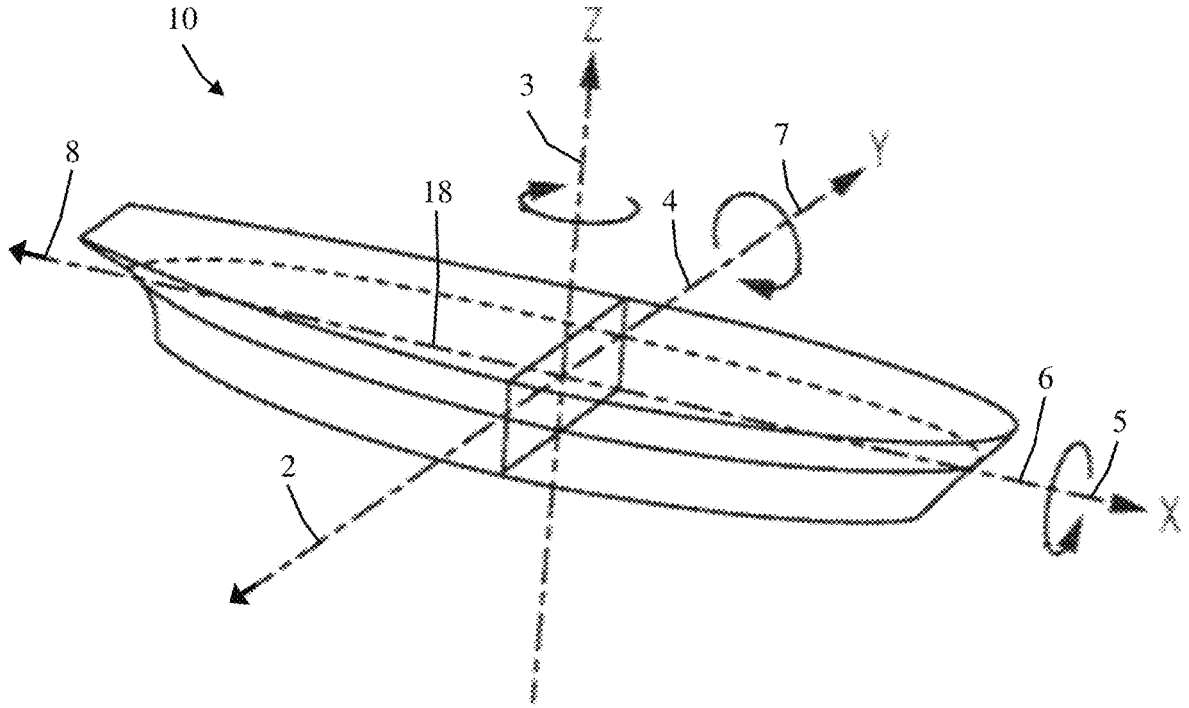
FIG. 6 is a schematic of a watercraft with axes of motion and rotation identified.

To facilitate the understanding of this disclosure, a number of marine terms are defined below. Terms defined herein have meanings as commonly understood by a person of ordinary skill in the areas relevant to the present disclosure. "Starboard" refers to the right-hand, or driver's, side of the watercraft. "Port" refers to the left-hand, or passenger's, side of the watercraft. "Bow" refers to the front of the watercraft. "Transom" and "stern" refer to the rear of the watercraft. The starboard 2, port 4, bow 6, and stern 8 directions are illustrated in FIG. 6 for reference. A yaw axis of rotation 3, a roll axis of rotation 5, and a pitch axis of rotation 7 are also illustrated in FIG. 6 for reference.

As used herein, "athwartship" refers to a sideways direction across a watercraft (e.g., in a direction at approximately a right angle to the fore-and-aft line of the watercraft.

Figure 1:
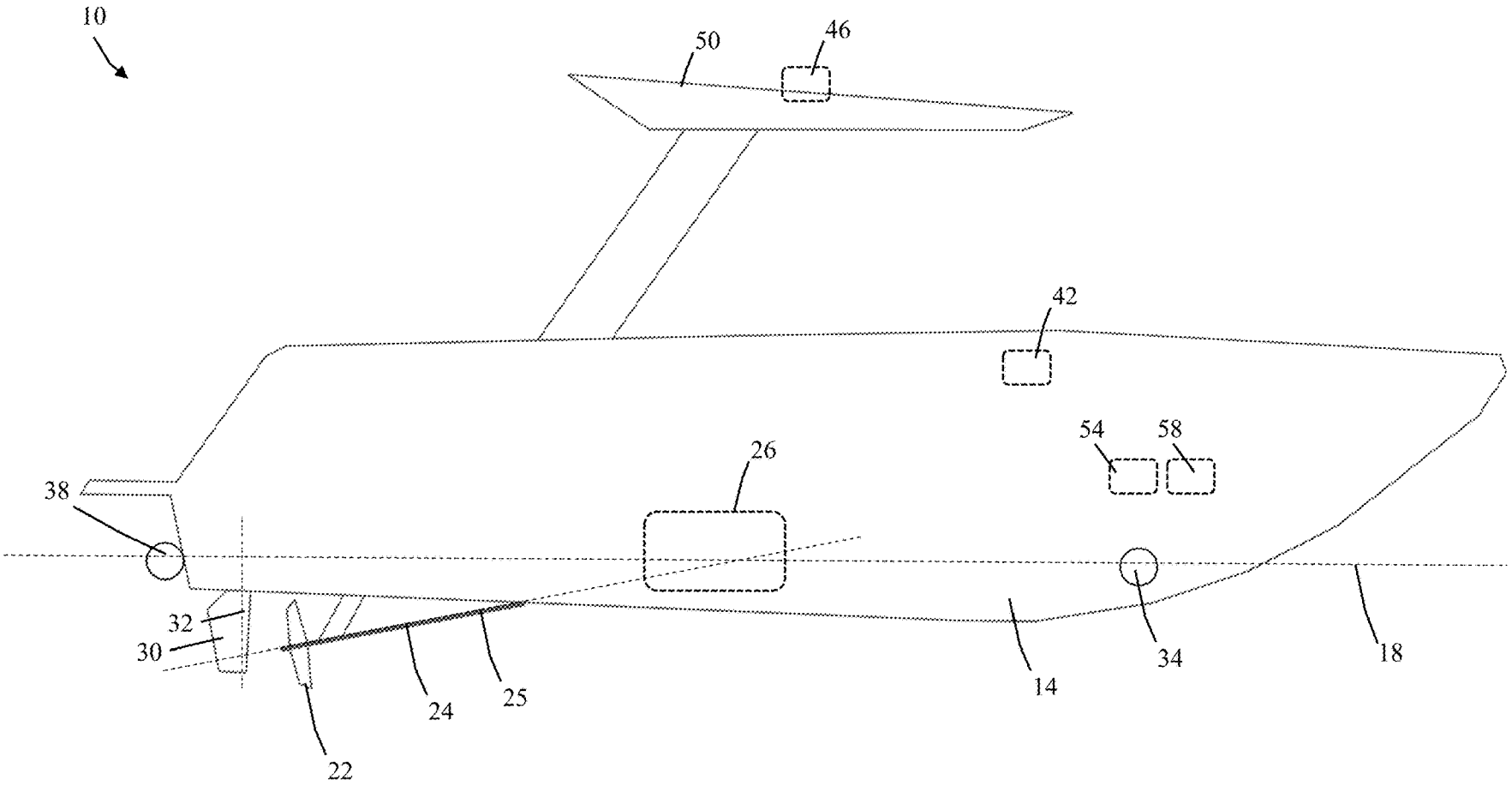
FIG. 1 is a side view of a watercraft with a propeller, a bow thruster, and a stern thruster.

With reference to FIG. 1, a watercraft 10 includes a hull 14 that defines a center bow-stern axis 18. In the illustrated embodiment, the watercraft 10 is propelled through the water by a propeller 22 that is rotationally driven by an electric drive. In the illustrated embodiment, a driveshaft 24 extends from the hull 14 along an axis 25 and is rotationally coupled to the propeller 22. In some embodiments, the electric drive includes an electric motor 26 (e.g., an induction motor, a synchronous motor, a brushless DC motor, a permanent magnet rotor, an interior permanent magnet motor, a surface permanent magnet motor, a reluctance motor, etc.) and a power converter (e.g., an inverter, a converter, etc.). In some embodiments, the watercraft 10 includes a battery electrically coupled to the electric drive. In some embodiments, the propeller 22 is coupled to an inboard motor, an outboard motor, or a sterndrive.

Figure 2:
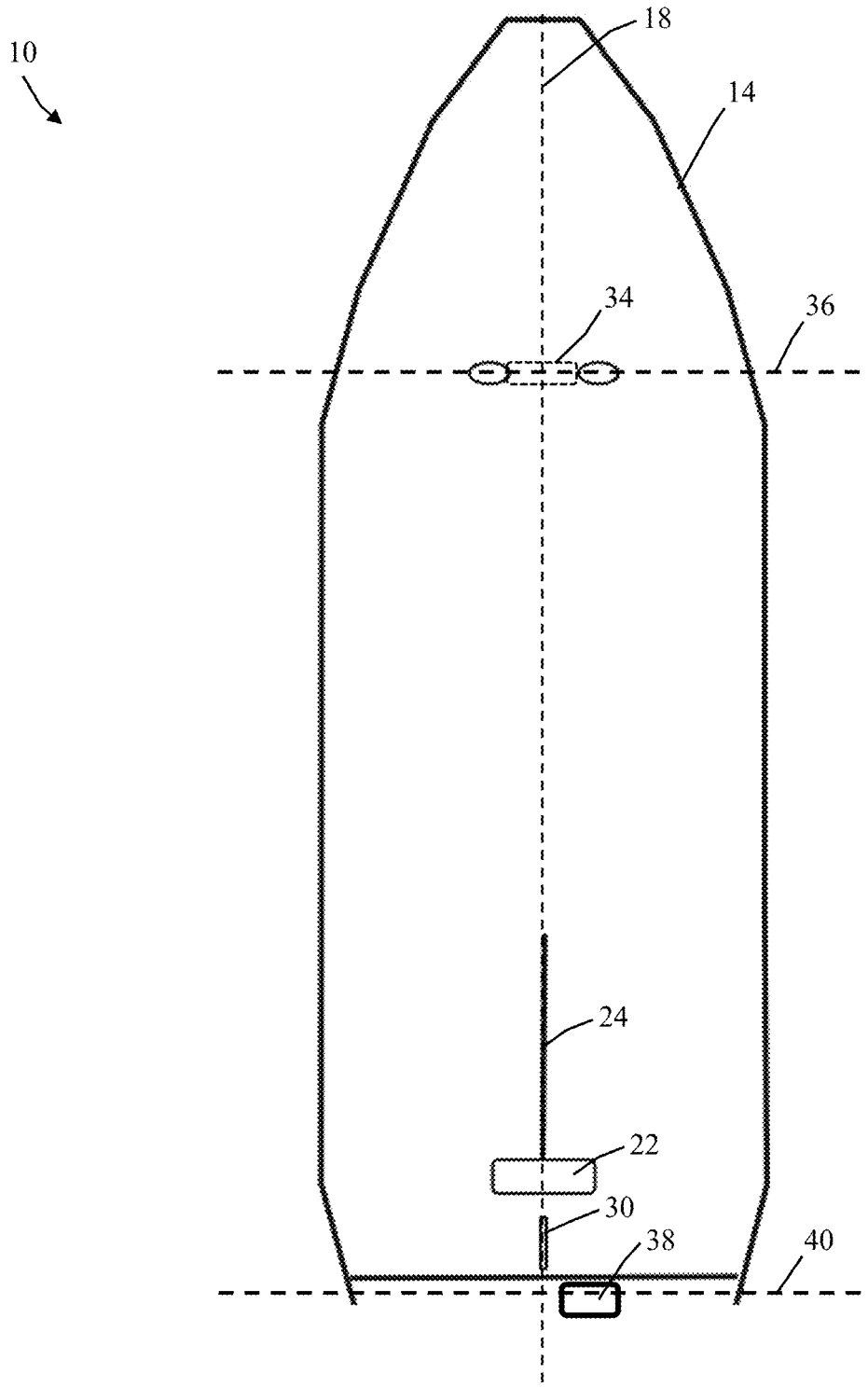
FIG. 2 is a bottom view of the watercraft of FIG. 1, illustrating the thrust axis of the bow thruster and the thrust axis of the stern thruster.

With reference to FIG. 2, the propeller 22 is positioned along the center bow-stern axis 18. In other words, the propeller 22, in the illustrated embodiment, is positioned along a current heading axis (e.g., current heading axis 66, FIG. 3A) of the watercraft 10. The propeller 22 is configured to propel the watercraft 10 in a forward or reverse direction when the propeller 22 is energized (e.g., rotationally driven). In some embodiments, the propeller 22 is only source of forward propulsion for the watercraft 10. In other embodiments, the watercraft includes more than one propeller for providing forward propulsion. In some embodiments, the watercraft includes two propellers that are each positioned spaced from the center bow-stern axis. The watercraft 10 is steered through the water with adjustment of a rudder 30 about a rudder axis 32 in response to movement of a steering wheel, for example. In the illustrated embodiment, the rudder axis 32 intersects the axis 25 of the driveshaft 24.

With continued reference to FIGS. 1 and 2, the watercraft 10 includes a first thruster 34 coupled to the hull 14 and a second thruster 38 coupled to the hull 14. In the illustrated embodiment, the first thruster 34 is a bow thruster, and the second thruster 38 is a stern thruster. The propeller 22 is positioned between the first thruster 34 and the second thruster 38 along the bow-stern axis 18. In other words, at least one thruster is positioned forward of the propeller 22 (e.g., thruster 34) and at least one thruster is positioned behind the propeller 22 (e.g., thruster 38). In the illustrated embodiment, the first thruster 34 is oriented along a first thruster axis 36 and the second thruster 38 is oriented along a second thruster axis 40. In some embodiments, the first thruster axis 36 and the second thruster axis 40 are parallel. In some embodiments, the first thruster axis 36 is orthogonal to the bow-stern axis 18. In some embodiments, the second thruster axis 40 is orthogonal to the bow-stern axis 18.

The first thruster 34 is embedded in the hull 14 and the second thruster 38 is embedded in the hull 14. In the illustrated embodiment, the orientation of the first thruster 34 and the orientation of the second thruster 38 are fixed relative to the hull 14. In some embodiments, the first thruster 34 and the second thruster 38 have an adjustable output power. In the illustrated embodiment, the first thruster 34 has an unexposed thruster propeller (e.g., a propeller within a tube, housing, or encasing). Likewise, the second thruster 38 an unexposed thruster propeller. As such, the thrusters 34, 38 are energized and the internal propellers rotate without having exposed rotating parts. In some embodiments, the thrusters are BOW PRO 48 VDC thrusters available from VETUS.

In the illustrated embodiment, the watercraft 10 includes a user input device 42 configured to receive an input from a user (e.g., a mode selection, a target position, etc.). In some embodiments, the user input device 42 receives an input from the user to engage or disengage a station keeping mode. In some embodiments, the user input device 42 is a control knob, a touch screen, or a combination thereof. As detailed further herein, the watercraft 10 enters a station keeping mode in response to receiving an input on the user input device 42. Advantageously, the propeller 22 is de-energized in the station keeping mode. Instead, the first thruster 34 and the second thruster 38 (which do not have exposed propellers) are energized in the station keeping mode. As such, the watercraft 10 provides a station keeping mode that is safe for swimmers to swim in the area surrounding the watercraft 10 without concern for the propeller 22 being energized.

With continued reference to FIG. 1, the watercraft 10 includes a GPS antenna 46 configured to measure a position of the watercraft 10. In some embodiments, the GPS antenna 46 is positioned on a tower assembly 50. In some embodiments, the watercraft 10 includes an inertial measurement unit (IMU) 54 configured to measure, among other things, a heading of the watercraft 10. In some embodiments, the IMU 54 includes a magnetometer. In some embodiments, the IMU 54 is coupled to the hull 14. In some embodiments, the watercraft 10 includes a compass 58 configured to measure, among other things, a heading of the watercraft 10.

Figure 3A:
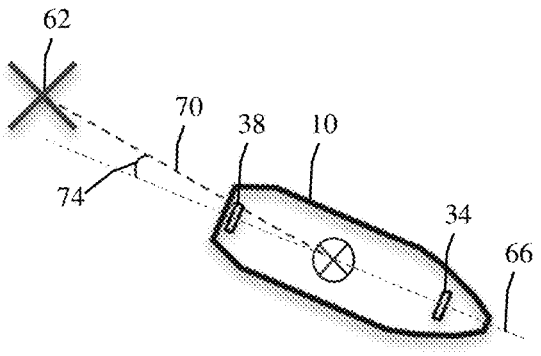
FIG. 3A is a top view schematic of a watercraft and a target position.

With reference to FIGS. 3A-3D, an overview of a method 100 (FIG. 5) for controlling a watercraft 10 is illustrated. FIG. 3A an operator decides a target position 62 for the watercraft 10. Then, with reference to FIG. 3B, torque is applied to the watercraft 10 by the thrusters 34, 38 to rotate the watercraft 10 such that the target position 62 is athwartship. In the illustrated embodiment, the watercraft 10 is rotating about the yaw axis 3 such that a current heading axis 66 of the watercraft 10 is adjusted.

Figure 3B:
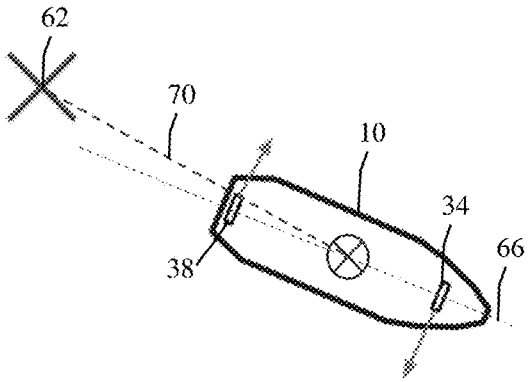
FIG. 3B is a top view schematic of a watercraft with energized thrusters to rotate the watercraft.
Figure 3C:
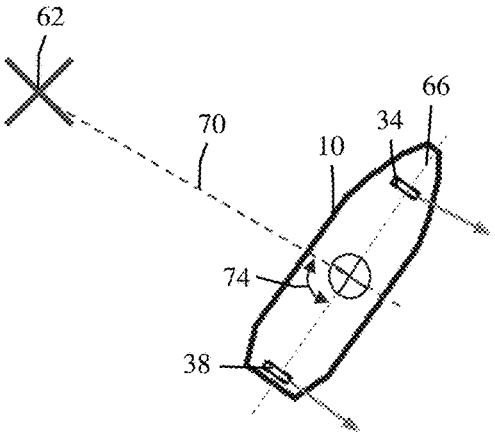
FIG. 3C is a top view schematic of a watercraft with a heading axis orthogonal to a position error axis, and energized thrusters to reduce the position error between the watercraft and the target position.

Next, with reference to FIG. 3C, force is applied to the watercraft 10 by the thrusters 34, 38 to move the watercraft 10 towards the target position 62 along a position error axis 70. As the watercraft 10 moves toward the target position 62 via the thrusters 34, 38, the current heading axis 66 is approximately orthogonal to the position error axis 70. In other words, the current heading axis 66 intersects the position error axis 70 at an angle 74, and the angle 74 is approximately 90 degrees.

Figure 3D:
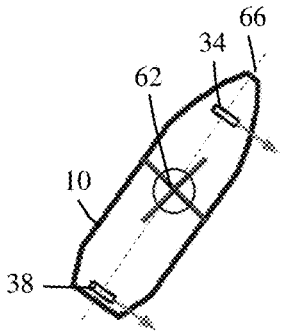
FIG. 3D is a top view schematic of a watercraft with energized thrusters to maintain position.

Then, with reference to FIG. 3D, the thrusters 34, 38 are energized to hold the target position 62. In some embodiments, once the watercraft 10 is over the target position 62, the watercraft 10 will rotate itself about the yaw axis 3 as necessary to keep any disturbance forces (e.g., forces acting on the watercraft due to wind, current, etc.) athwartship. The thrusters 34, 38 are then used to oppose the disturbance force acting on the watercraft 10.

Figure 5:
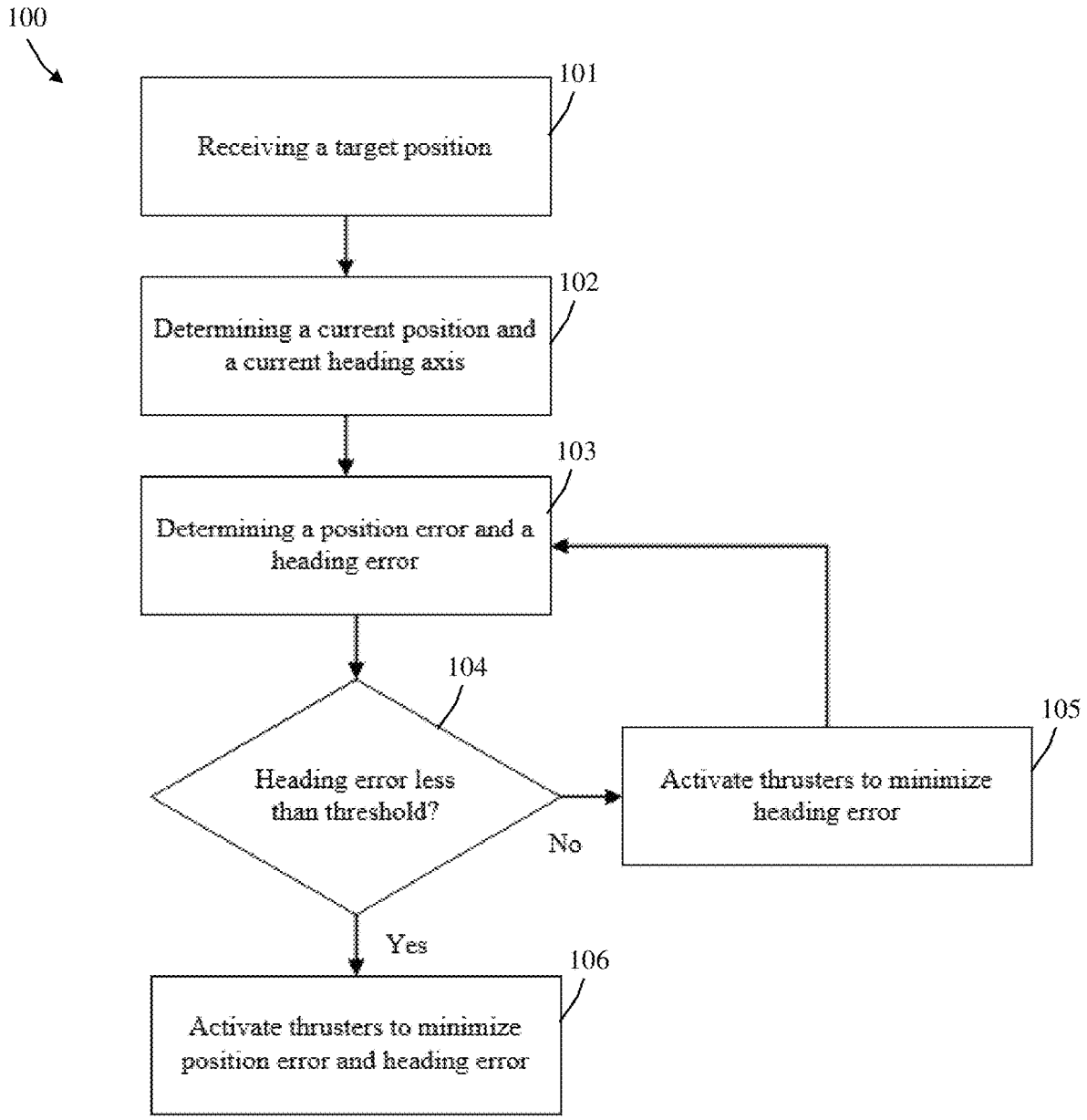
FIG. 5 is a flow diagram illustrating a method of station keeping for the watercraft of FIG. 1.

With reference to FIG. 5, the method 100 includes (STEP 101) receiving a target position 62 for the watercraft 10. In some embodiments, the target position 62 is received as an operator input on an input device (e.g., the user input device 42).

The method 100 further includes (STEP 102) determining a current position and a current heading axis 66 of the watercraft. In some embodiments, the current position is based on a measurement from a GPS, a measurement from an inertial measurement unit, or a combination thereof. In some embodiments, the current heading axis 66 is based on a measurement from an inertial measurement unit, a measurement from a compass, a measurement from a GPS, or a combination thereof.

The method 100 further includes (STEP 103) determining a position error based on the difference between the target position and the current position. A position error axis 70 is defined between the target position 66 and the current position. (STEP 103) further includes determining a heading error based on the current heading axis 66 and a desired heading axis. The desired heading axis is orthogonal to the position error axis 70 (FIG. 3C). In other words, the goal is to have the current heading axis 66 orthogonally intersect the position error axis 70 (e.g., the angle 74 equal approximately 90 degrees).

The method 100 further includes (STEP 104) determining when the heading error is less a threshold. In some embodiments, the threshold is approximately 5 degrees. In some embodiments, the threshold is approximately 10 degrees. In some embodiments, the threshold is approximately 15 degrees. In some embodiments, the threshold is within a range of approximately 5 degrees to approximately 15 degrees.

If the heading error is not less than the threshold (e.g., No at STEP 104), the method 100 includes (STEP 105) activating a plurality of thrusters (e.g., thrusters 34, 38) to minimize the heading error (FIG. 3B). In some embodiments, activating the plurality of thrusters to minimize the heading error causes the watercraft to rotate about the yaw axis 3.

If the heading error is less than the threshold (e.g., Yes at STEP4), the method 100 includes (STEP 106) activating the plurality of thrusters to minimize the position error (FIG. 3C). In other words, the method 100 includes activating the plurality of thrusters to minimize the position error in response to determining the heading error is less than the threshold at STEP 104. In some embodiments, the method 100 further comprises activating the plurality of thrusters to minimize the heading error in response to determining the heading error is less than the threshold at STEP 104. In other words, the thrusters are energized to continue to minimize the heading error simultaneously with minimizing the position error.

Figure 4:
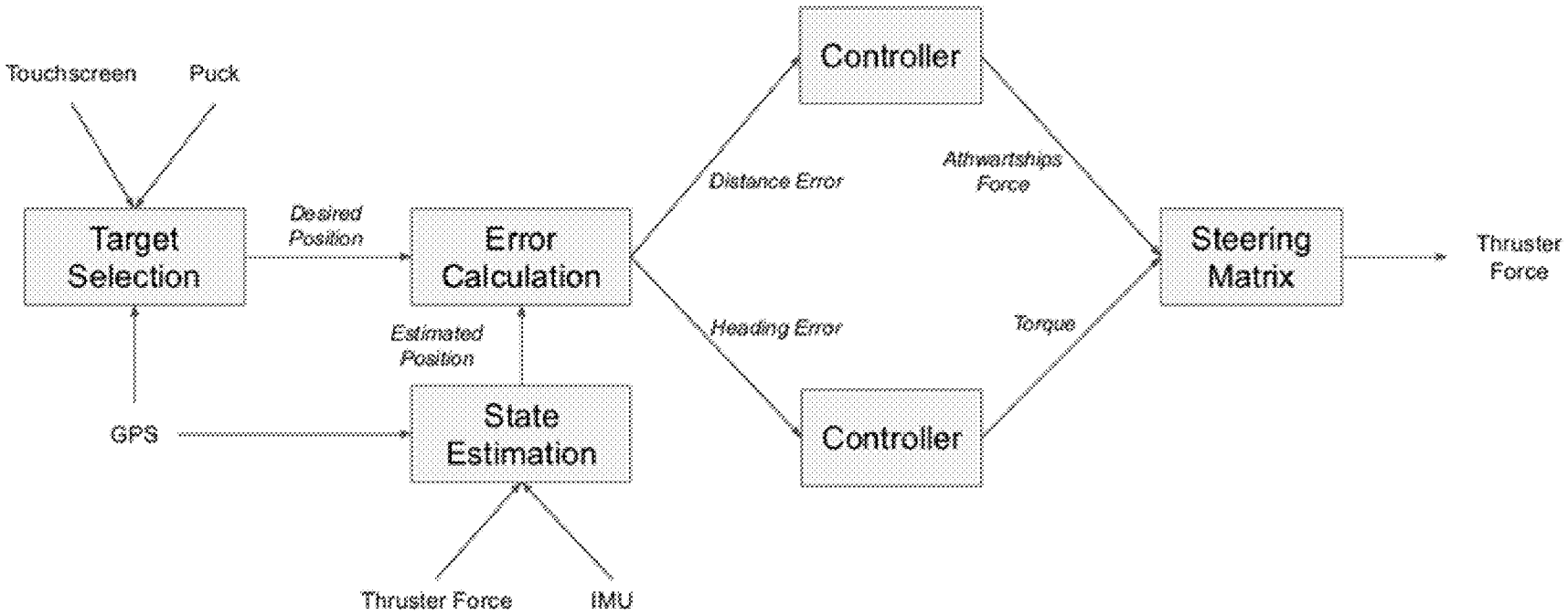
FIG. 4 is a flow diagram illustrating a method of station keeping for the watercraft of FIG. 1.

With reference to FIG. 4, one embodiment of a station keeping method is illustrated including target selection, state estimation, and error calculation. The error calculations (distance and heading error) are inputs to controllers. The outputs from the controllers are inputs to a steering matrix. The steering matrix determines the throttle for the thrusters 34, 38 based on the controller outputs.

As detailed herein, the propeller is de-energized during the method 100. In some embodiments, the rotational speed of the propeller 22 is zero during the method 100. In some embodiments, the propeller 22 is deenergized in response to receiving the target position at (STEP 101). The deactivation of the main propeller or propellers creates a safe swimming area around the watercraft while the watercraft is maintaining a position within the water. In embodiments, where the watercraft includes more than one propeller to propel the watercraft forward, the additional propellers are energized during the method of station keeping—with only the thrusters energized. As disclosed herein, the watercraft 10 holds its position while in water without the user of an anchor or the main inboard propeller.

In the illustrated embodiment, the watercraft 10 is a boat. In other embodiments, the watercraft is a fishing boat, a dingy boat, a deck boat, a bowrider boat, a catamaran boat, a cuddy cabin boat, a center console boat, a houseboat, a trawler boat, a cruiser boat, a game boat, a yacht, a personal watercraft boat, a water scooter, a jet-ski, a runabout boat, a jet boat, a wakeboard, a ski boat, a life boat, a pontoon boat, or any suitable motor boat, vessel, craft, or ship. Although examples are illustrated with respect to an all-electric watercraft, the methods and systems described herein can also be used in a conventional motorboat application (e.g., with a gasoline or diesel-powered engine).

Various features and advantages are set forth in the following claims.

What is claimed is:

1. A method comprising:

receiving a target position for a watercraft;

determining a current position and a current heading axis of the watercraft;

determining a position error based on the difference between the target position and the current position; wherein a position error axis is defined between the target position and the current position;

determining a heading error based on the current heading axis and a desired heading axis, wherein the desired heading axis is orthogonal to the position error axis;

activating a plurality of thrusters to minimize the heading error;

determining when the heading error is less than a threshold; and in response to determining the heading error is less than the threshold, activating the plurality of thrusters to minimize the position error and the heading error.

2. The method of claim 1, wherein the target position is received as an operator input on an input device.

3. The method of claim 1, wherein determining the current position is based on a measurement from a GPS, a measurement from an inertial measurement unit, or a combination thereof.

4. The method of claim 1, wherein determining the current heading axis is based on a measurement from an inertial measurement unit, a measurement from a compass, a measurement from a GPS, or a combination thereof.

5. The method of claim 1, wherein activating the plurality of thrusters to minimize the heading error causes the watercraft to rotate about a yaw axis.

6. The method of claim 1, wherein the threshold within a range of 5 degrees to 15 degrees.

7. The method of claim 1, wherein the watercraft includes a propeller configured to propel the watercraft when the propeller is energized, and wherein the propeller is deenergized during the method.

8. The method of claim 7, wherein the propeller is positioned along the current heading axis.

9. The method of claim 7, wherein the propeller is a first propeller, and wherein the watercraft includes a second propeller configured to propel the watercraft when the second propeller is energized, and wherein the second propeller is deenergized during the method, and wherein the first propeller and the second propeller are positioned spaced from the current heading axis.

10. The method of claim 1, wherein a propeller on the watercraft is deenergized in response to receiving the target position.

11. The method of claim 1, wherein the watercraft comprises:

a hull defining a center bow-stern axis;

a propeller positioned along the center bow-stern axis;

a first thruster coupled to the hull; wherein the first thruster is oriented along a first thruster axis;

a second thruster coupled to the hull; wherein the second thruster is oriented along a second thruster axis;

wherein the orientation of the first thruster and the orientation of the second thruster are fixed relative to the hull; and wherein the first thruster axis and the second thruster axis are parallel;

wherein the propeller is positioned between the first thruster and the second thruster along the bow-stern axis; and wherein the propeller is de-energized when activating the plurality of thrusters to minimize the heading error, and wherein the propeller is de-energized when activating the plurality of thrusters to minimize the position error and the heading error.

12. A watercraft comprising:

a hull defining a center bow-stern axis;

a user input device;

a propeller positioned along the center bow-stern axis;

a first thruster coupled to the hull; wherein the first thruster is oriented along a first thruster axis;

a second thruster coupled to the hull; wherein the second thruster is oriented along a second thruster axis;

wherein the orientation of the first thruster and the orientation of the second thruster are fixed relative to the hull; and wherein the first thruster axis and the second thruster axis are parallel;

wherein the propeller is positioned between the first thruster and the second thruster along the bow-stern axis;

wherein the watercraft enters a station keeping mode in response to receiving an input on the user input device; wherein the propeller is de-energized in the station keeping mode; and wherein the first thruster and the second thruster are energized in the station keeping mode;

wherein when the watercraft is in the station keeping mode, the watercraft;

determines a current position and a current heading axis of the watercraft;

determines a position error based on the difference between a target position and the current position; wherein a position error axis is defined between the target position and the current position;

determines a heading error based on the current heading axis and a desired heading axis, wherein the desired heading axis is orthogonal to the position error axis;

activates a plurality of thrusters to minimize the heading error;

determines when the heading error is less than a threshold; and in response to determining the heading error is less than the threshold, activates the plurality of thrusters to minimize the position error and the heading error.

13. The watercraft of claim 12, further comprising a GPS antenna configured to measure a position of the watercraft.

14. The watercraft of claim 12, further comprising an inertial measurement unit configured to measure a heading of the watercraft.

15. The watercraft of claim 12, further comprising a compass configured to measure a heading of the watercraft.

16. The watercraft of claim 12, wherein the first thruster and the second thruster have an adjustable output power.

17. The watercraft of claim 12, wherein the user input device is a control knob, a touch screen, or a combination thereof.

18. The watercraft of claim 12, wherein the propeller is coupled to an inboard motor.

19. The watercraft of claim 12, wherein the first thruster is embedded in the hull and has an unexposed thruster propeller; and wherein the second thruster is embedded in the hull and has an unexposed thruster propeller.

* * * * *